US006929556B1

(12) United States Patent
Wolbert

(10) Patent No.: US 6,929,556 B1
(45) Date of Patent: Aug. 16, 2005

(54) TEE UP GOLF PRACTICING DEVICE

(76) Inventor: Mark A. Wolbert, 16138 Hwy. 169, Milaca, MN (US) 56353

( * ) Notice: Subject to any disclaimer, the term of this patent is extended or adjusted under 35 U.S.C. 154(b) by 0 days.

(21) Appl. No.: 10/799,218

(22) Filed: Mar. 12, 2004

Related U.S. Application Data

(60) Provisional application No. 60/455,065, filed on Mar. 13, 2003.

(51) Int. Cl.[7] ..... A63B 57/00
(52) U.S. Cl. ..... 473/137
(58) Field of Search ..... 473/132–137

(56) References Cited

U.S. PATENT DOCUMENTS

| | | | | |
|---|---|---|---|---|
| 1,940,321 A | * | 12/1933 | Pagett | 473/137 |
| 2,071,356 A | * | 2/1937 | Pagett | 473/137 |
| 2,216,853 A | | 10/1940 | Middleton | 273/33 |
| 3,003,770 A | * | 10/1961 | Jones | 473/134 |
| 4,796,893 A | | 1/1989 | Choi | 273/201 |
| 4,957,296 A | | 9/1990 | Turnidge et al. | 273/201 |
| 5,458,339 A | | 10/1995 | Wildes | 273/201 |
| 5,674,130 A | | 10/1997 | Egan | 473/133 |
| 5,860,870 A | | 1/1999 | Park | 473/136 |
| 6,174,243 B1 | | 1/2001 | Choi | 473/137 |
| 6,179,719 B1 | | 1/2001 | Hwang | 473/137 |
| 6,328,659 B1 | | 12/2001 | Peterson | 473/137 |

* cited by examiner

*Primary Examiner*—Steven Wong
(74) *Attorney, Agent, or Firm*—Nikolai & Mersereau, P.A.

(57) ABSTRACT

A golf ball teeing machine having a convenient carrying case for easily transporting the machine in suitcase fashion by a handle on the top. When set down the top is opened to reveal a golf ball magazine, which may be filled with golf balls. With the top open one side of the case pivots at the base to form a tee off pad with a golf tee centered therein. The golf tees are replaceable and come in different heights. Artificial grass may be snapped onto the tee off pad for easily replacing or removing the grass. Golf balls are delivered to the tee by a pedal sending one ball at a time down a tilting ramp. The tee off pad is attached to the case such that the tee is always in alignment with the tilting ramp for placement of balls on the tee.

7 Claims, 12 Drawing Sheets

TEE UP GOLF PRACTICING DEVICE

This application is a nonprovisional patent application based on provisional patent application 60/455,065 filed Mar. 13, 2003.

BACKGROUND OF THE INVENTION

1. Field of the Invention

The present invention relates generally to automatic golf ball teeing devices and more specifically a device having all the components in one suitcase like package, which has a reservoir of golf balls at the top, with a gravity feed, and automatic ball dispensing for placing golf balls on a tee.

2. Description of the Prior Art

Automatic golf ball positioning devices have been in use however they have suffered from several drawbacks. The main problem with conventional automatic golf ball positioning devices are that they are not dependable (they do not work 100% of the time), the golf balls get stuck on the way and/or they over run the tee. Another problem with conventional automatic golf ball positioning devices is that they are expensive and cumbersome to transport from one location to another. Another problem with some automatic golf ball positioning devices is that they need electric power to work. Other golf ball teeing devices have to be bolted to a base to keep the device aligned with the tee.

SUMMARY OF THE INVENTION

The portable golf ball teeing machine is housed in a suitcase like package, that opens to provide a flat pad with replaceable artificial grass and a tee on a support perpendicular to a golf ball dispensing gravity feed mechanism. The portable golf ball teeing machine uses a gravity feed and an activating pedal which is activated by pressing on it, usually with the end of a golf club. The golf tee is replaceable should it become worn. The golf tee can be of several different heights to suit the desires of the user. The side of the portable golf ball teeing machine opens from the suit case like housing by being hinged at the base of the housing and folds out perpendicular to the housing with the tee in alignment for use with the ball placing arm. The tee is mounted on a pad having artificial grass to simulate teeing off on a golf course. The artificial grass is snapped on to the pad and can be easily replaced. The gravity feed portable golf ball teeing machine does not require electricity to operate.

OBJECTS OF THE INVENTION

It is an object of the present invention to provide an automatic golf tee up device for golf practice at home, in the office, or in the field, having all the components in a suitcase like package, that opens to provide an upright gravity fed automatic ball dispensing portion with a perpendicular pad having a golf tee and artificial grass.

Another object is to provide an automatic golf teeing device for practicing golf swings that works well indoors and outdoors, and does not have to be anchored to the ground.

Another object is to provide a tee up golf practicing device that is molded out of impact resistant thermoplastic resin, which will withstand the impact of a misdirected golf ball or a hit by a golf club.

Another object is to provide a tee up golf practicing device that will be capable of storing a large number of golf balls, and placing them efficiently on a tee.

Another object is to provide a tee up golf practicing device that to provide a device that will be easy to transport from one location to another, and will lock in to a suitcase like case with a handle.

Another object is to provide an automatic golf ball teeing up device that will have an activating pedal for releasing a golf ball to be placed on the golf tee.

Another object is to provide a tee up golf practicing device that has the capability of accepting alternate tee heights.

Another object is to provide a tee up golf practicing device that is modular, so that it is easy to assemble and such that broken or worn parts can be easily replaced.

Another object of the invention is to provide a teeing device which does not require alignment of the tee with the placement device so that the golf balls are always delivered aligned with the tee.

Other objects, advantages and novel features of the present invention will become apparent from the following description of the preferred embodiments when considered in conjunction with the accompanying drawings.

DESCRIPTION OF THE PREFERRED EMBODIMENT

Figure 1:
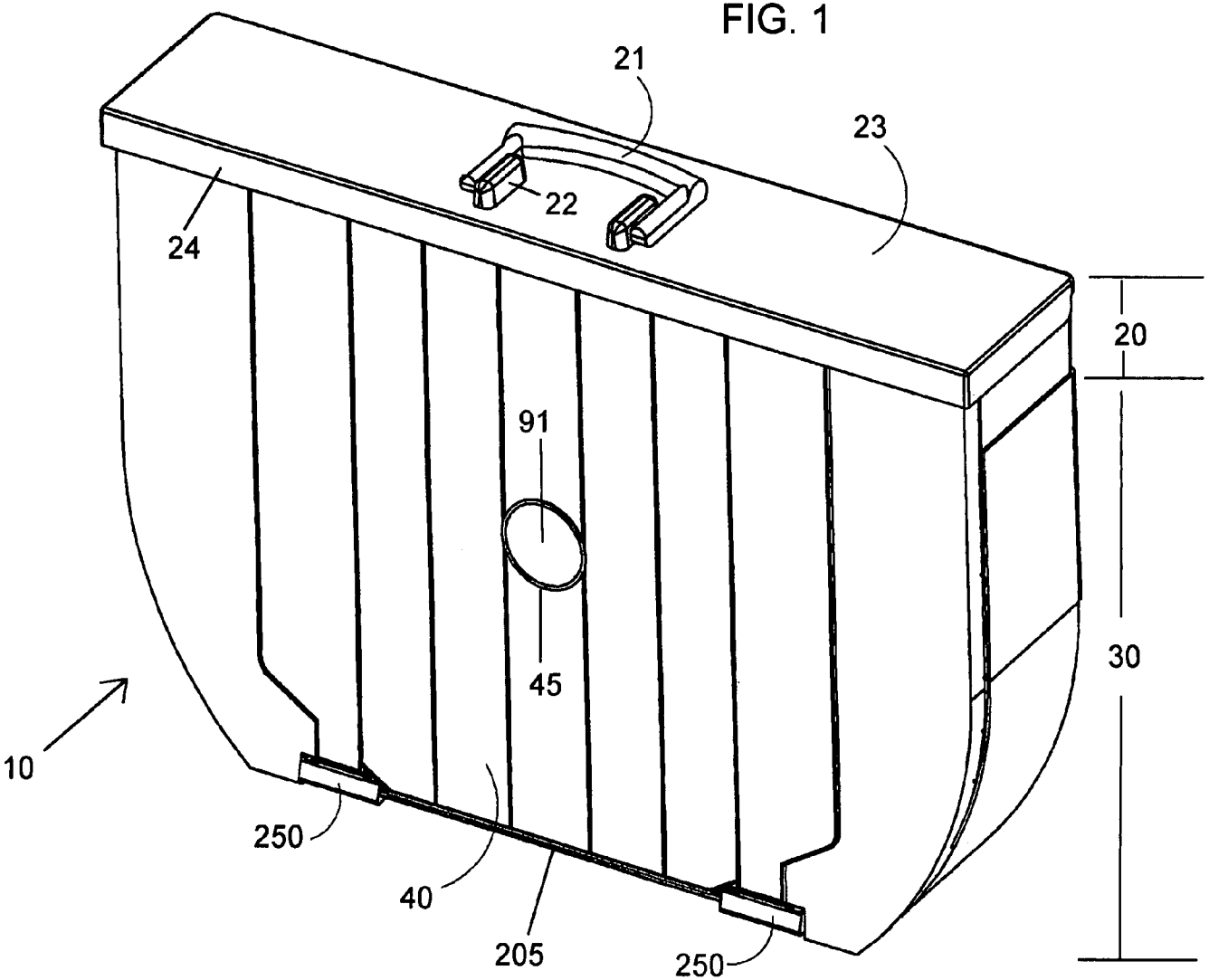
FIG. 1 is a side perspective view of the portable golf ball teeing machine with the tee pad in the closed position with the top closed for carrying the device.
Figure 2:
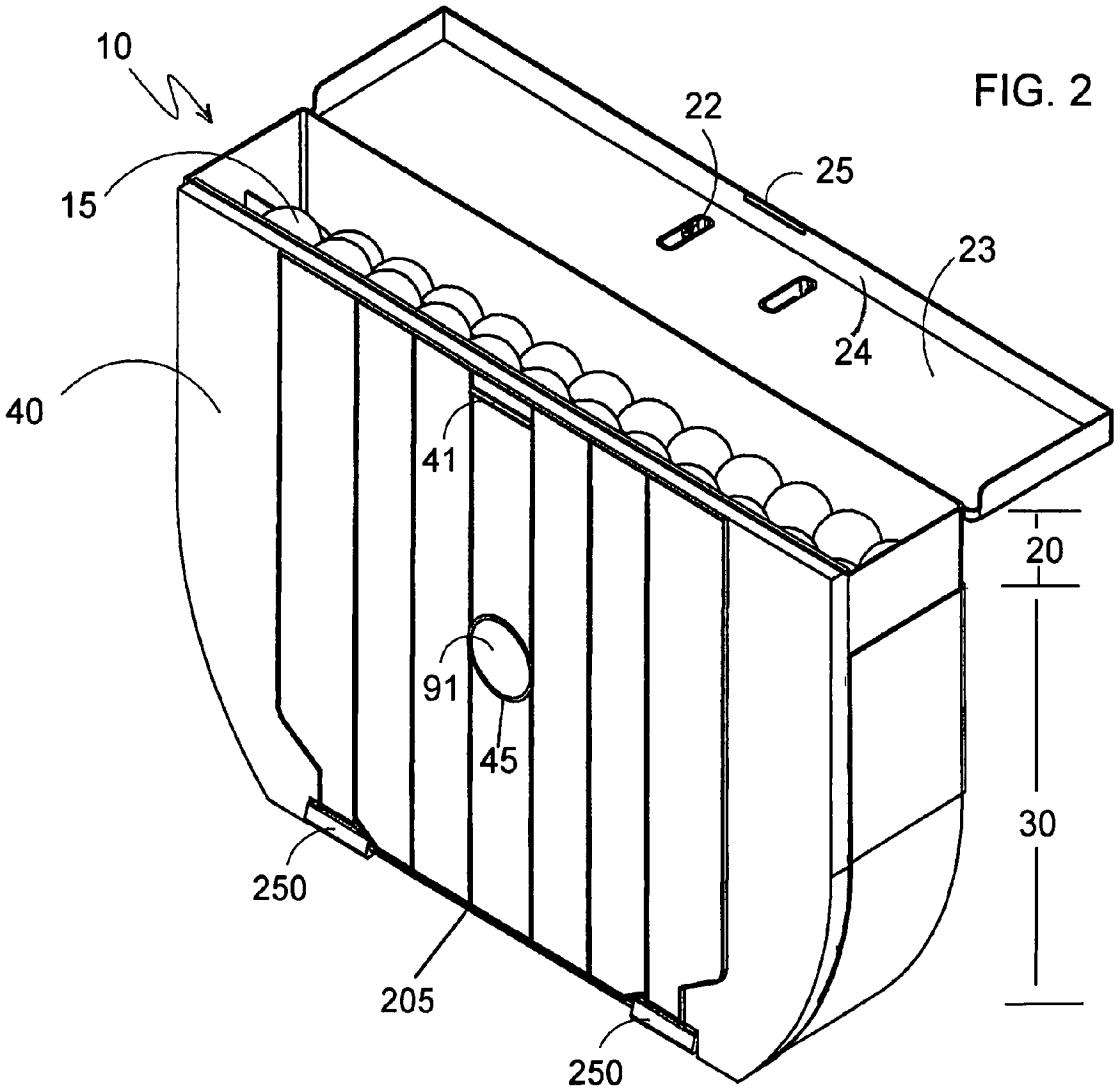
FIG. 2 is a side perspective view of the portable golf ball teeing machine with the top open and golf balls placed in the magazine.
Figure 3:
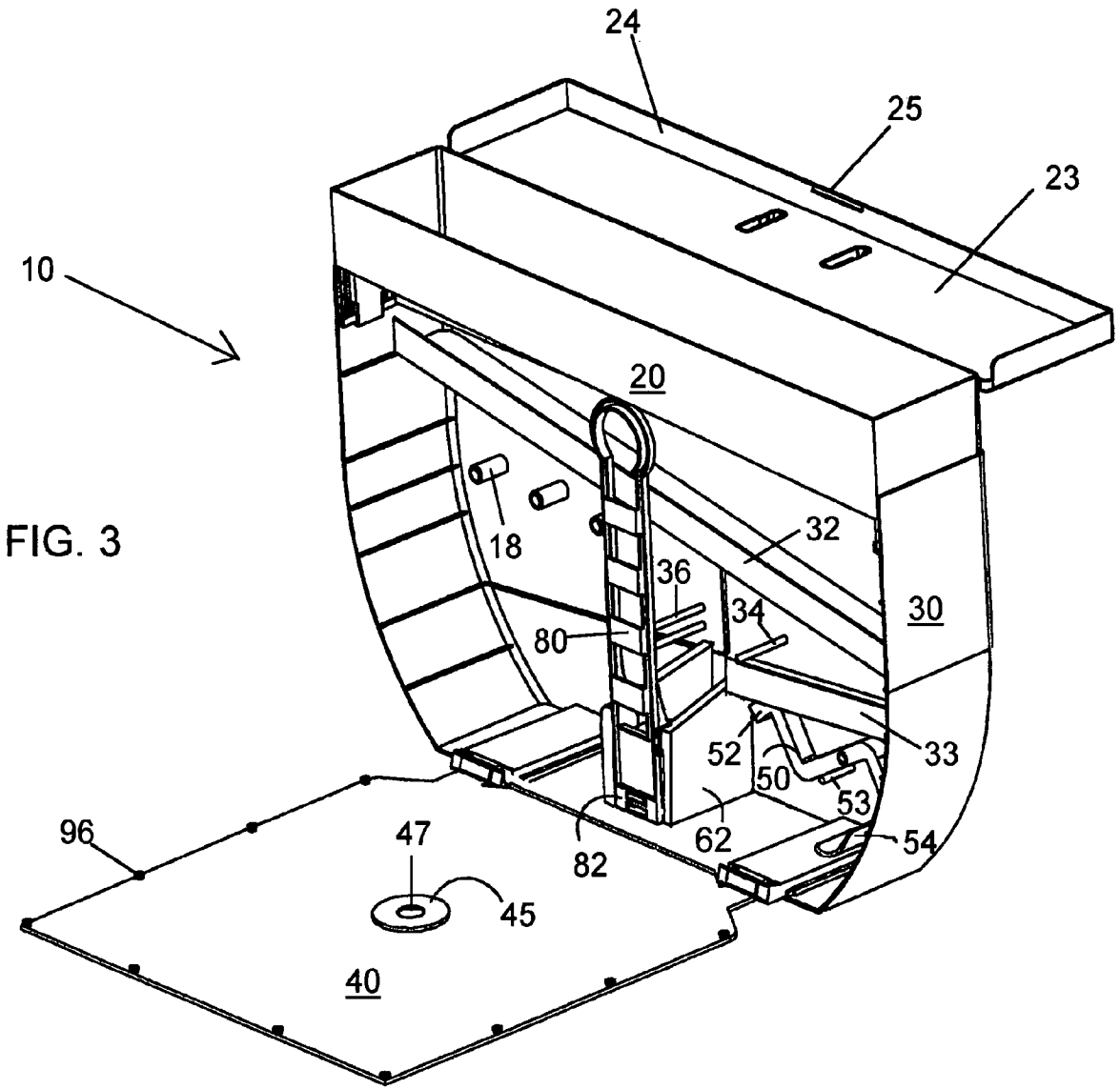
FIG. 3 is a side perspective view of the portable golf ball teeing machine with the tee pad perpendicular to the housing and the tilting ramp in the up position.
Figure 4:
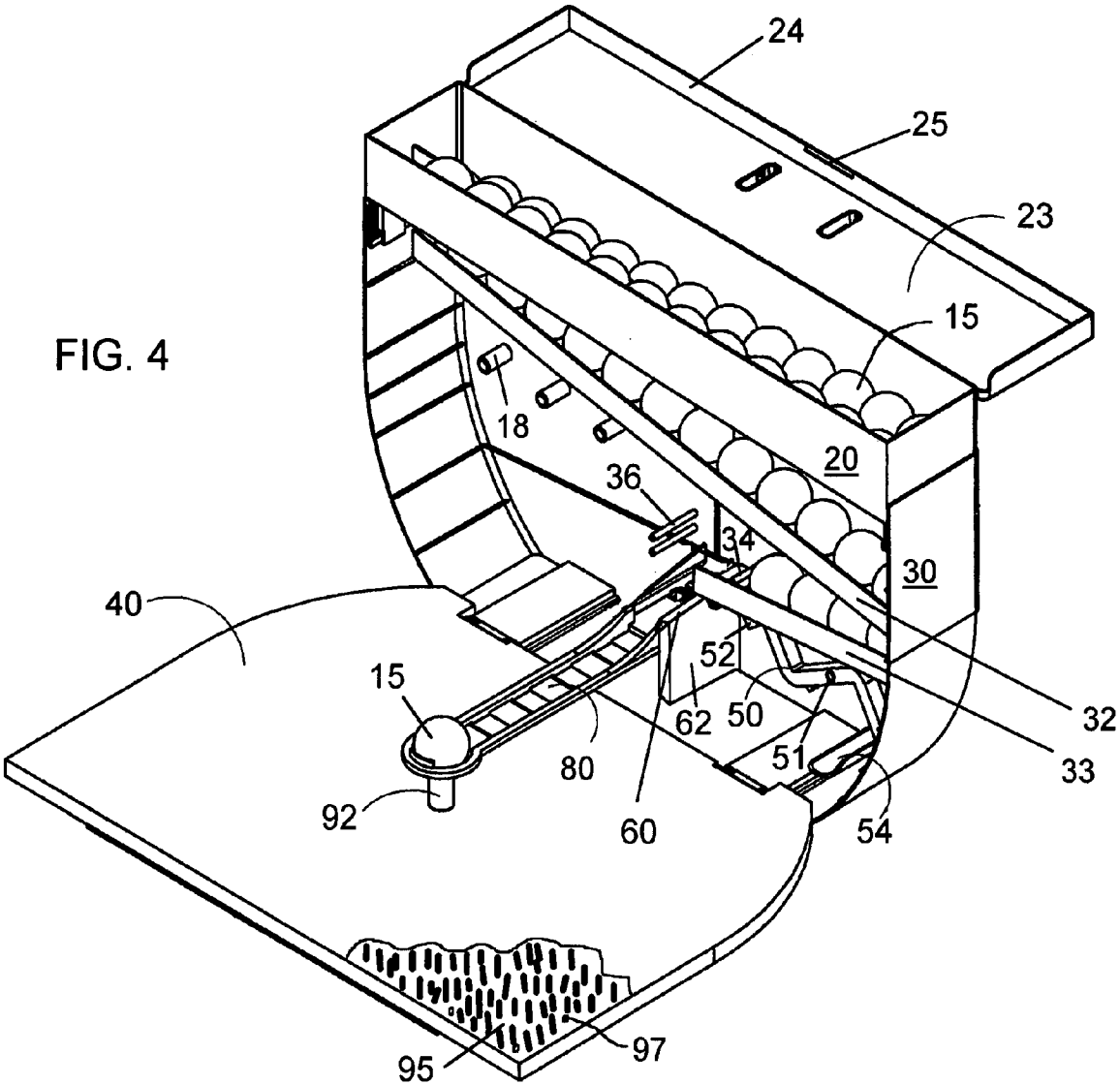
FIG. 4 is a side perspective view of the portable golf ball teeing machine with the tee pad perpendicular to the housing and the tilting ramp in the down position.

The portable golf ball teeing machine 10 is shown in FIG. 1 folded up onto a suitcase like configuration for easily transporting it to a location for use. The portable golf ball teeing machine 10 is assembled from three major components, a top portion 20, an upright housing 30, and a tee pad 40.

Figure 6:
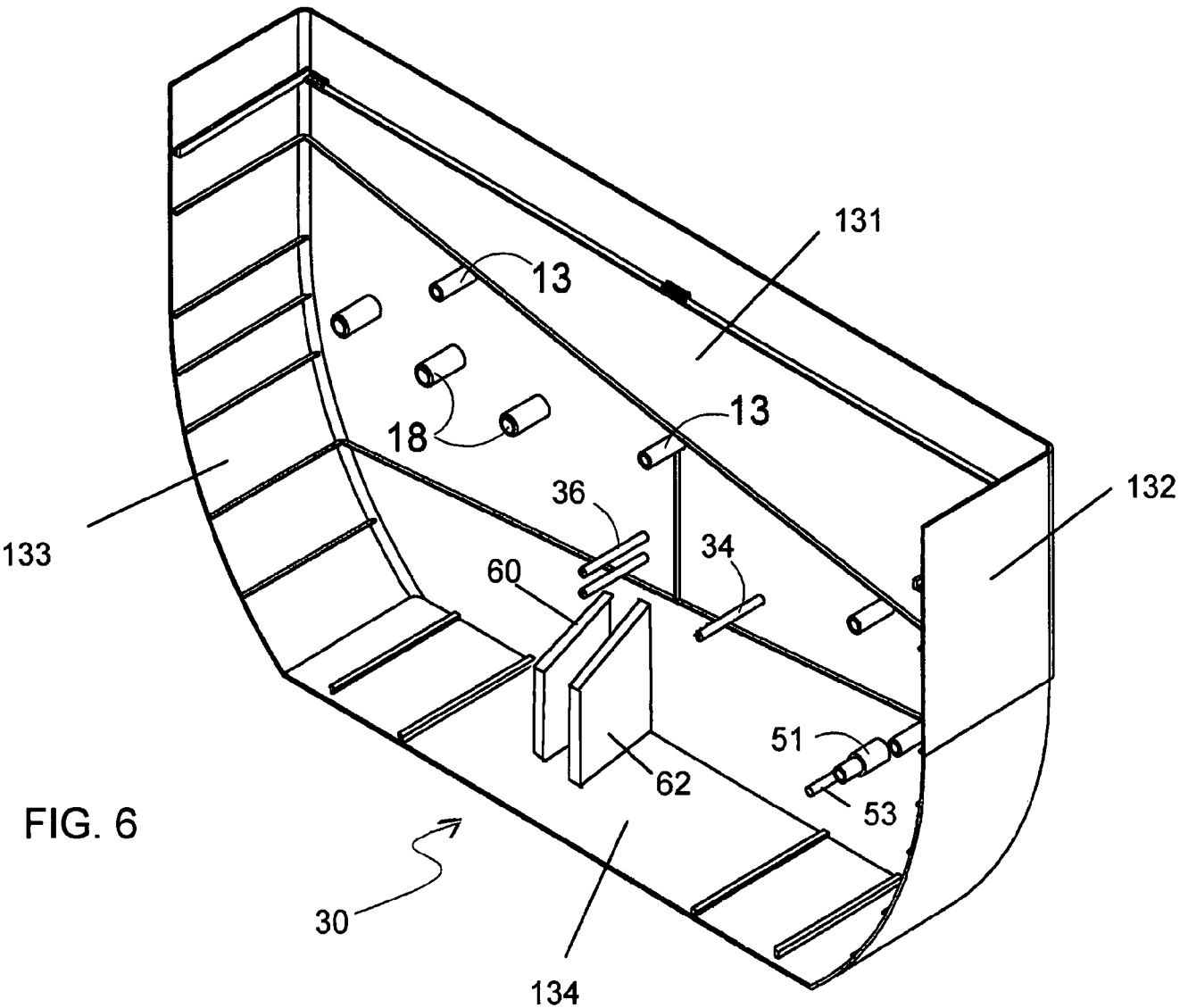
FIG. 6 is a side perspective view of the housing of the portable golf ball teeing machine.

As shown in FIG. 6 the upright housing 30 has a back wall 131, a first side wall 132, a second side wall 133, and a base 134. The front wall is the tee pad 40 when it is pivoted into its upright position.

Figure 5:
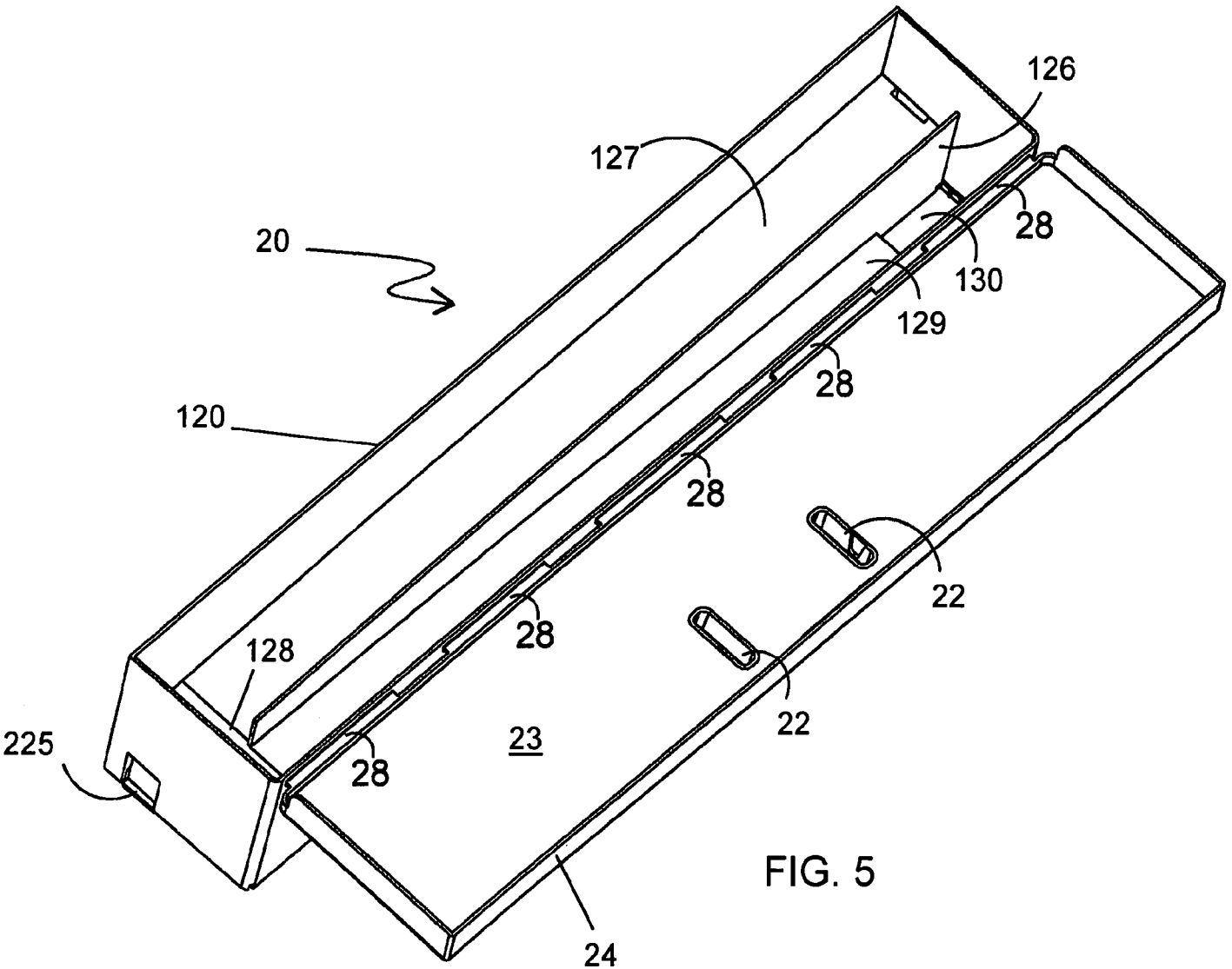
FIG. 5 is a top perspective view of the top portion of the portable golf ball teeing machine.

The top portion 20 has a handle 21 pivotably attached to rails 22 on the top of the lid 23. Lid 23 is hingedly attached to top portion 20 by living hinges 28 as shown in FIG. 5. The lid 23 has a lip 24 with a ridge 25 which locks by overlapping a latch ridge 41 on tee pad 40 to lock the tee pad 40 in the upright position and the lid 20 to the tee pad 40 such that the lid 20 will stay closed when the portable golf ball teeing machine 10 is carried by its handle 21. The lid 23 is opened by pressing the tee pad 40 inward proximate the latch ridge 41 and/or by pulling the lip 24 proximate the ridge 25 away from the latch ridge 41 so they no longer overlap and the lid 23 can be opened.

Inside of the top portion 20, as seen in FIG. 5, is a magazine 120 for holding golf balls 15. The magazine 120 has an upper ramp 127 with a dividing wall 126 and a cross over portion 128 where the golf balls pass through an opening in the wall 126 to access a lower ramp 129 on the other side of the dividing wall 126. The lower ramp 129 ends at opening 130 where the golf ball drops down approximately one golf ball diameter to ramp 32 in housing 30. The drop of approximately one golf ball diameter is so that a golf ball in the queue can rest on top of the golf ball on ramp 32 and the remaining golf balls will stay in a queue on ramps 129 and 127.

Figure 7:
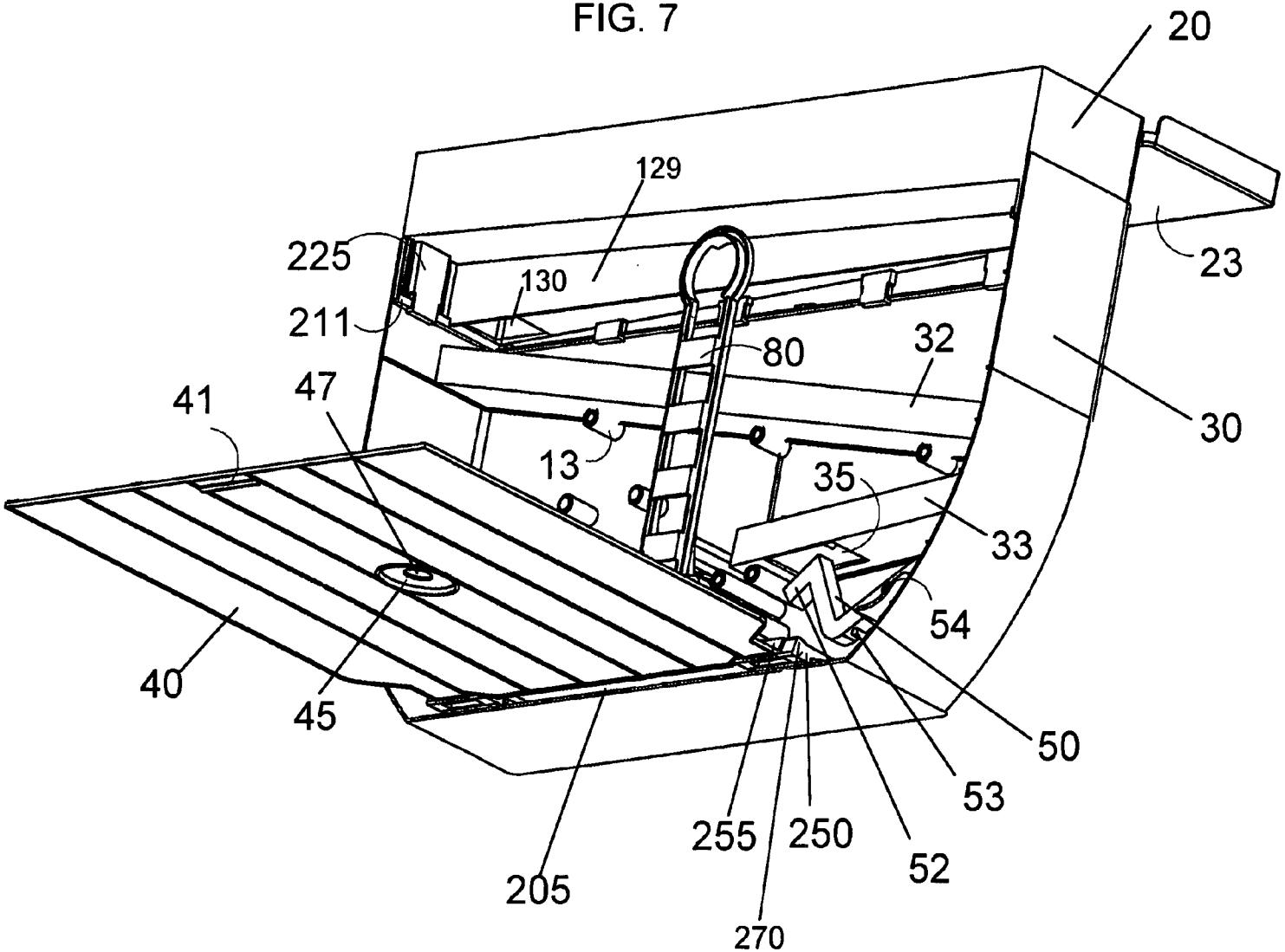
FIG. 7 is a side perspective view of the portable golf ball teeing machine from below to show the activating pedal.

Ramp 32 is sloped downward across housing 30 to an opening at the end of the ramp (not shown) for again allowing the golf ball to drop approximately one golf ball diameter to ramp 33 which slopes in the opposite direction from ramp 32 to a ball stopping peg 34. Ball stopping peg 34 stops the golf ball 15 from further rolling down ramp 33. Ramp 33 has an aperture 35, as shown in FIG. 7, proximate the peg 34 for the golf ball 15 to partially drop therein, which depresses the ball-engaging portion 52 of activating pedal lever 50.

Figure 8:
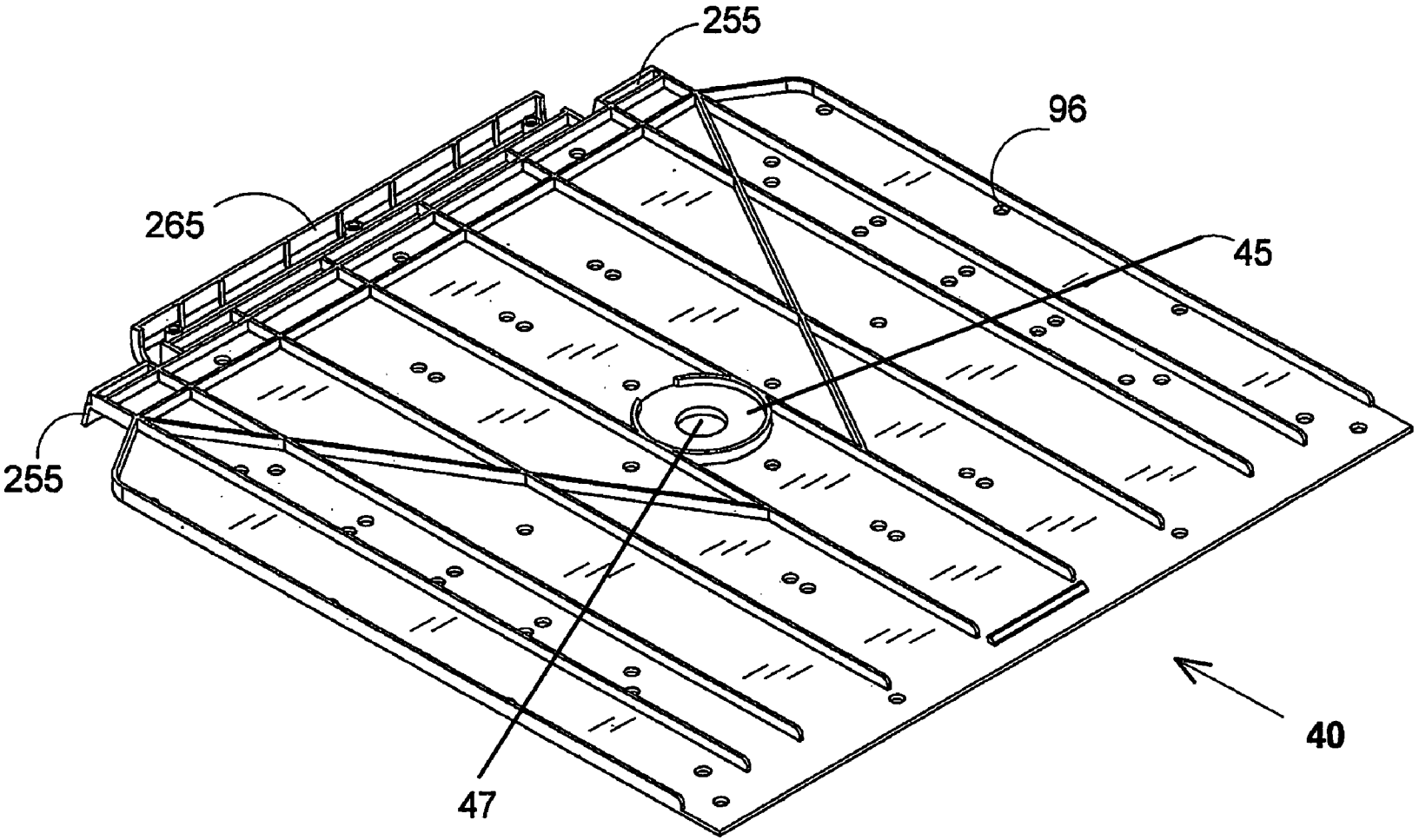
FIG. 8 is a perspective view of the bottom of tee pad.
Figure 9:
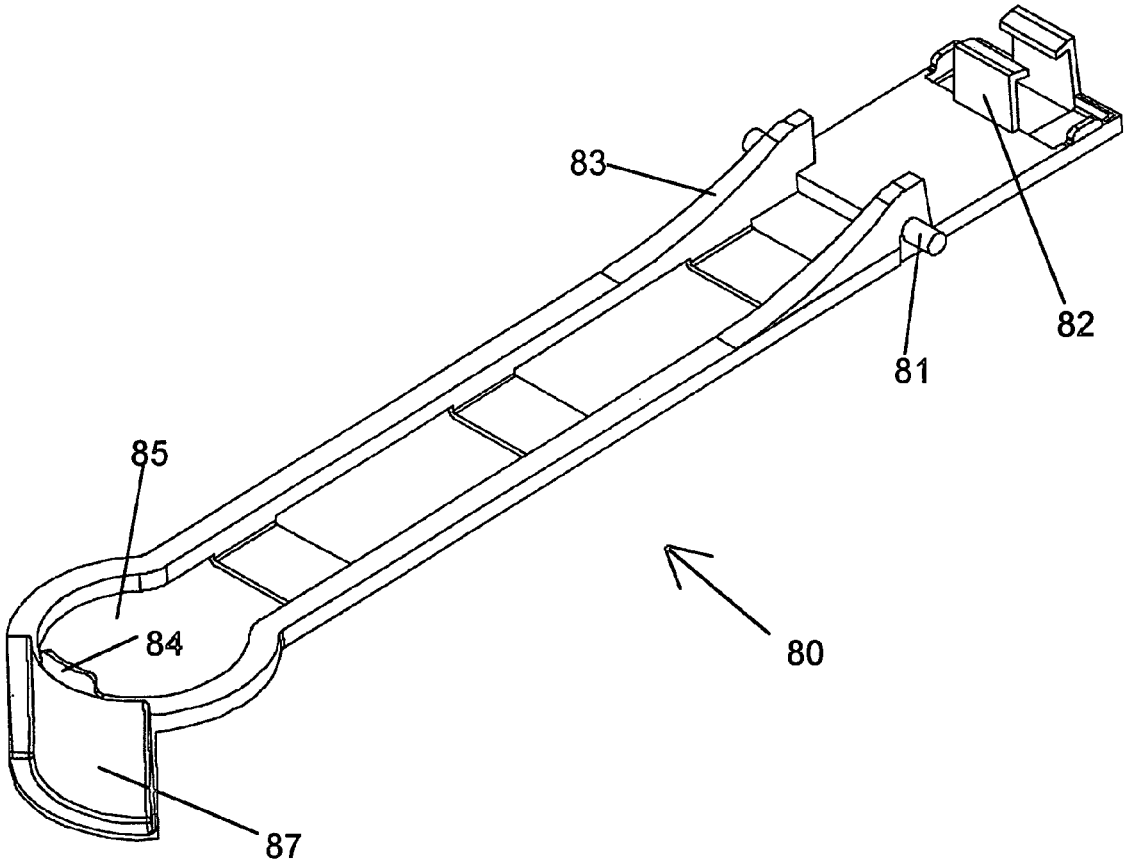
FIG. 9 is a top perspective view of the tilting ramp.

Activating pedal lever 50 is pivotally mounted on pivot pin 51 (FIG. 6). When a golf ball engages and depresses the ball engaging portion 52 (FIG. 7) of the activation pedal lever 50 it rotates on pin 51 until stopped by pin 53. In this position pedal 54 is pushed upward such that it is ready to be depressed by the end of a golf club or some other object which will push a golf ball 15 upward and over ball stopping peg 34 such that the golf ball rolls onto ramp 60 in housing 30 and rolls down to tilting ramp 80 which rotates on pegs 81 pivotally connected to walls 62 in housing 30. Stopping pegs 36 prevent the golf ball from passing over ramp 60 and help guide the golf ball into place on ramp 60. Ramp 60 is integral with the top of walls 62. Tilting ramp 80 has pins 81 which pivot in slots in walls 62. As shown in FIG. 8, tilting ramp 80 is counter balanced by a weight placed in weight holder 82 such that the tilting ramp 80 stands upright when not engaged by a golf ball. When a golf ball is present on ramp 60 it pushes tilting ramp 80 downward and rolls down track 83 to golf ball aperture 85 at the end of the tilting ramp 80 where it is stopped from further travel by guard 84. As the golf ball 15 rolls down the tilting ramp 80 the ball aperture end descends to a position directly over the golf tee 90. There is preferably a shield 87 at the end of the tilting ramp 80, which prevents the tilting ramp 80 from tilting beyond top of the golf tee 90 and allows the golf balls to be placed on the top of the tee 90.

Figure 10:
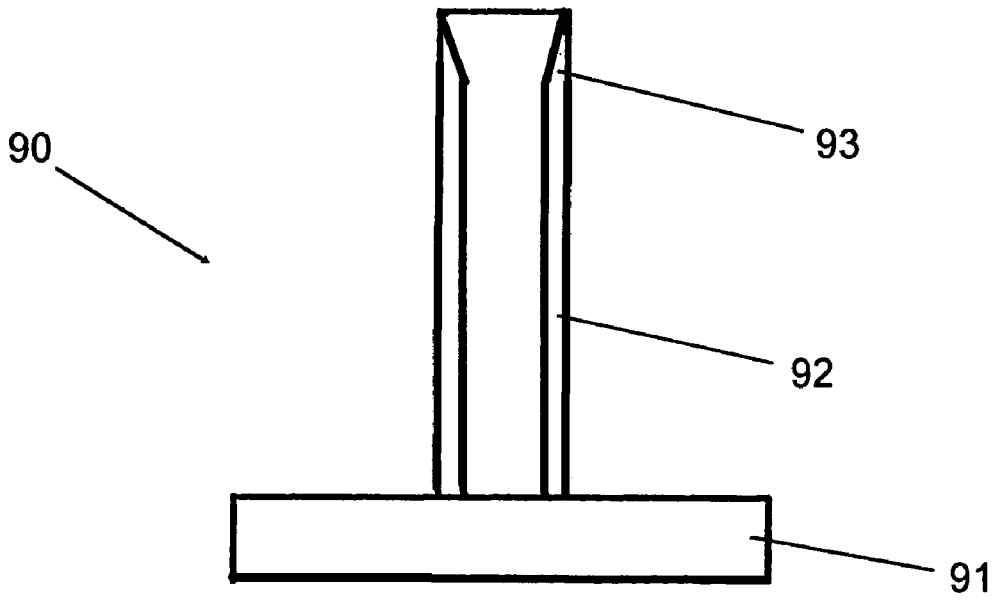
FIG. 10 is a cross sectional view of a tee.

The golf tee 90, shown in FIG. 10, is preferably made of a soft rubber such that it can bend with golf club impacts without damaging the tee. The golf tee 90 may be of different heights to suit the user. The golf tee 90 has a round base 91 for fitting into round depression 45 in the tee pad 40. The tube like column 92 of the golf tee 90 passes though the tee aperture 47 in the tee pad 40. Different height tees are available and can be stored on pegs 18 in housing 30. The top of the tee is preferably beveled 93 to more securely hold the golf ball in the center of the tee 90.

The golf ball teeing machine 10 as shown is molded three parts. The top portion 20 which is attached to the upright housing 30, preferably by snap on connectors 225 and 211 as shown in FIG. 7. The tee pad 40 is hingedly connected to the upright housing 30 by hinge 205 such that the tee pad 40 opens to a position perpendicular to the upright housing 30. The tee pad 40 is securely attached to the upright housing 30 such that no separate means are needed to keep the tilting ramp 80 aligned with the tee 90. The tee pad 40 opens to a position perpendicular to the housing by the use of stopping pads 255 on the tee pads 40 engaging bumpers 250 on the housing 30 as the tee pad 40 opens to be perpendicular to the housing 30. The bumpers 250 are preferably rubber. It is important for the housing 30 to remain perpendicular to the tee pad 40 when in use to align the tee 90 with the tilting ramp 80. A biasing force to keep the housing 30 and the tee pad at 90 degrees can be provided by springs or a hump 270 on the bumpers having a flat surface 250, which interacts with the stopping pads 255 on the tee pad 40 to prevent the tee pad 40 from pivoting toward the housing 30. The tee pad 40 had a hinge housing portion 265 which attaches to a complimentary hinge housing portion on the housing 30 to secure the tee pad 40 to the housing 30.

Artificial turf 95 can be snapped on to the tee pad 40 by pegs 97 on the artificial turf fitting into apertures 96 in the tee pad 40. If the artificial turn becomes worn it can be easily replaced by unsnapping the worn artificial turf 95 and replacing it with new artificial turf.

After practicing hitting golf balls it is convenient to have a device for picking up the golf balls without having to bend over. A shag stick 300 having a first hollow tube 301 inside of a second hollow tube 303 and a locking mechanism 305 for fixing the position of the first hollow tube 301 relative to the second hollow tube 303 allows for an extendable shag stick 300 for holding golf balls therein. The golf balls are picked up by use of a clam shell 306 arrangement having opposing arms 307 which separate to allow a golf ball to enter the second hollow tube 303 when the shag stick is pressed down over the top of a golf ball thus spreading the arms of the clam shell until the center part of the ball passes the end of the claim shell arms 307. After the ball is admitted to the claim shell the arms 307 close behind the ball and the ball is trapped inside. When the balls are collected the cap 309 of the shag 300 stick is removed and the balls can roll out of the shag stick and into the magazine or some other container.

Figure 11:
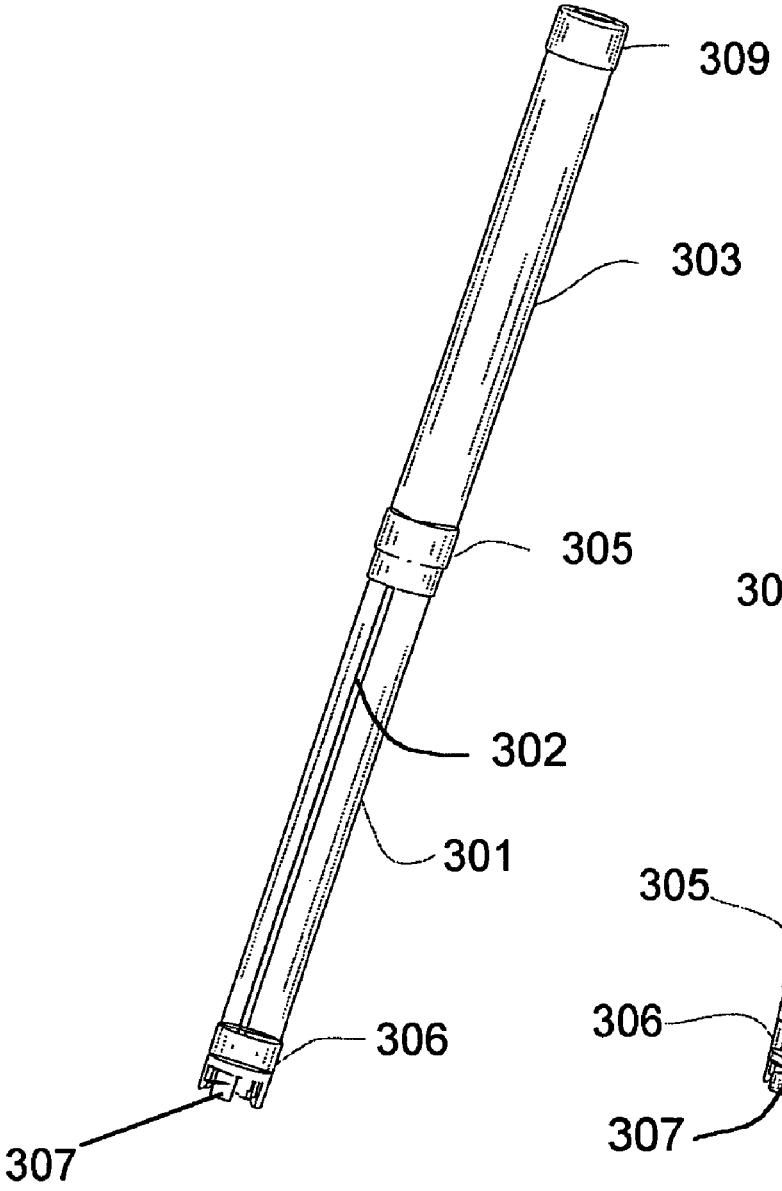
FIG. 11 is a perspective view of the telescoping shag stick extended.
Figure 12:
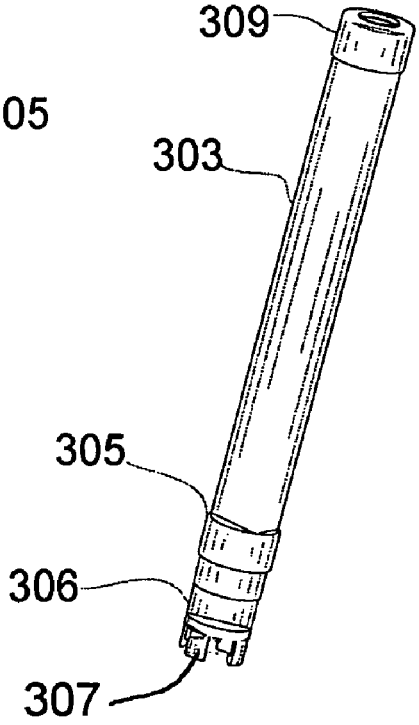
FIG. 12 is a perspective view of the telescoping shag stick collapsed.
Figure 13:
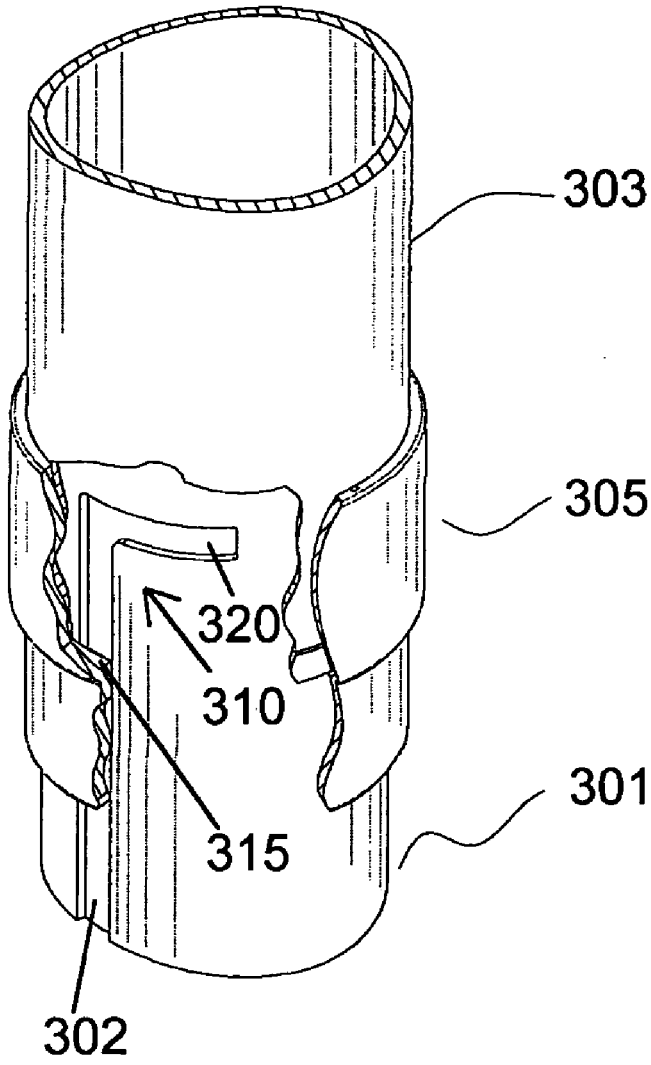
FIG. 13 is a cut away perspective view of the locking mechanism of the shag stick.

In the embodiment shown in FIGS. 11–13 the first hollow tube 301 has a slot 302 running substantially the length of the tube 301. There is an "L" shaped portion 310 near one end of the tube such that tab 315 in locking mechanism 305 which rides in slot 302 can lock tube in an extended position shown in FIG. 10 by turning tube 301 relative to tube 303 and forcing tab 315 into the arm 320 of the "L" shaped portion 315.

Obviously, many modifications and variations of the present invention are possible in light of the above teachings. It is therefore to be understood that, within the scope of the appended claims, the invention may be practiced otherwise than as specifically described.

What is claimed is:

1. A golf ball teeing device comprising:

an upright housing, having three upstanding walls, and a base, a top portion hingedly attached to the top of the upright housing, a tee pad having a golf tee thereon, the tee pad hingedly attached to the upright housing at the base such that it forms a fourth upstanding wall of the housing when in a closed position and pivots perpendicular to the closed position to form an open position providing a golf tee to place golf balls on, the upright housing having a hinged lid with a handle on top of the hinged lid for carrying the golf ball teeing device, the lid having a ridge for engaging a latch on the tee pad for locking the tee pad in the closed position when the lid is closed over the top portion, a sloped ramp in the top portion forms a golf ball magazine such that golf balls placed therein will roll to the lower end of the ramp, an aperture at the lower end of the ramp for golf balls to drop through and enter the housing, a ramp in the housing for receiving golf balls from the top portion, the ramp sloping from the top portion toward the base of the housing, a ball stopping peg extending across the ramp for blocking further progress of the golf balls down the ramp, an aperture in the ramp upstream of the ball stopping peg and adjacent thereto for a golf ball to rest in and to depress a ball engaging arm of an activating pedal lever pivotably attached to the housing, and having a pedal on the opposite end of the activating pedal lever from the ball engaging arm, a perpendicular outgoing ramp downstream of the ball stopping peg, for receiving golf balls passing over the ball stopping peg by dint of the arm of the activating pedal lever, when the pedal thereon is depressed, a tilting ramp pivotally connected to the housing, and cooperating with the outgoing ramp, for tilting downward when a golf ball from the outgoing ramp engages it, the ramp being counterbalanced to remain upright when there are no golf balls engaging it and tilting down allowing a golf ball to roll to the end thereof when the tee pad is perpendicular to the upright housing, an aperture at the end of the tilting ramp to allow a golf ball to pass therethrough, and place the golf ball on the tee mounted on the tee pad and aligned with the aperture in the tilting ramp.

2. A golf ball teeing device as in claim 1 having, an artificial grass pad attached to the tee pad to simulate a grass portion of a golf course.

3. A golf ball teeing device as in claim 2 wherein, the grass pad attaches to the tee pad by snaps such that it is easily replaceable.

4. A golf ball teeing device as in claim 1 having, an aperture in the tee pad admits a tee such that tees may be easily changed.

5. A golf ball teeing device as in claim 1 having, tee storing pegs in the upright housing for storing tees thereon.

6. A golf ball teeing device as in claim 1 having, a shag stick having two telescoping tubes and a means for locking the tubes in an extended position, opposing resilient arms at one end of a telescoping tubes for allowing a one way insertion of balls at that end and a removable cap for balls to exit the shag stick at the other end of the telescoping tubes, the shag stick fitting inside of the ball magazine when the telescoping tubes are in a collapsed position.

7. A golf ball teeing device as in claim 1 having, a means for securing the tee pad in a position perpendicular to the housing for aligning the tilting ramp with the golf tee.

* * * * *